US005426262A

United States Patent [19]

Kitayama et al.

[11] Patent Number: 5,426,262

[45] Date of Patent: Jun. 20, 1995

[54] ELECTRONIC MUSICAL INSTRUMENT CAPABLE OF SIMULATING SMALL PITCH VARIATION AT INITIATION OF MUSICAL TONE GENERATION

[75] Inventors: Toru Kitayama; Iwao Higashi; Tomoyuki Funaki, all of Hamamatsu, Japan

[73] Assignee: Yamaha Corporation, Japan

[21] Appl. No.: 920,197

[22] Filed: Jul. 23, 1992

[30] Foreign Application Priority Data

Jul. 26, 1991 [JP] Japan ..... 3-187838

[51] Int. Cl.[6] ..... G10H 7/00; G10H 1/06

[52] U.S. Cl. ..... 84/622; 84/659; 84/661

[58] Field of Search ..... 84/630, 622, 660, 661, 84/659

[56] References Cited

U.S. PATENT DOCUMENTS

| | | | |
|---|---|---|---|
| 4,984,276 | 1/1991 | Smith | 84/630 X |
| 4,984,276 | 1/1991 | Smith . | |
| 5,000,074 | 3/1991 | Inoue et al. | 84/630 X |
| 5,113,743 | 5/1992 | Higashi | 84/622 |
| 5,117,729 | 6/1992 | Kunimoto | 84/660 |
| 5,131,310 | 7/1992 | Kunimoto | 84/622 X |
| 5,136,917 | 8/1992 | Kunimoto | 84/661 X |
| 5,157,214 | 10/1992 | Nakanishi et al. | 84/622 |
| 5,182,415 | 1/1993 | Kunimoto | 84/660 |
| 5,187,313 | 2/1993 | Inoue | 84/622 |
| 5,187,314 | 2/1993 | Kunimoto et al. | 84/626 |
| 5,192,825 | 3/1993 | Kunimoto | 84/661 |
| 5,206,448 | 4/1993 | Kunimoto | 84/661 X |
| 5,223,656 | 6/1993 | Higashi | 84/661 |
| 5,245,127 | 9/1993 | Yamauchi et al. | 84/624 |
| 5,286,913 | 2/1994 | Higashi | 84/622 |
| 5,290,969 | 3/1994 | Kobayashi | 84/622 |

FOREIGN PATENT DOCUMENTS 63-40199 2/1988 Japan .

*Primary Examiner*—William M. Shoop, Jr.
*Assistant Examiner*—Jeffrey W. Donels
*Attorney, Agent, or Firm*—Graham & James

[57] ABSTRACT

An electronic musical instrument: is provided to perform an active control on the pitch of the musical tone to be generated, thereby simulating the pitch-rising phenomenon to be occurred in the performance of a non-electronic musical instrument such as a wind instrument, percussion instrument and stringed instrument. In case of the simulation of the wind instrument, this electronic musical instrument is mainly configured by an excitation-vibration circuit and a tube simulation circuit which are connected together by means of a junction. The tube simulation circuit is configured by a closed-loop circuit in which plural delay circuits and junction circuits are connected together in cascade-connection manner. Herein, the delay circuits simulate the propagation delay of the air-pressure wave to be transmitted through the tube of the wind instrument, while the junction circuits simulate the scattering manner of the air-pressure wave at the points at which the diameter of the tube is changed. The number of the delay stages which are required to simulate the musical sound is controlled to be changed in a lapse of time.

14 Claims, 7 Drawing Sheets

(PITCH/ENVELOPE GENERATING CIRCUIT 31)

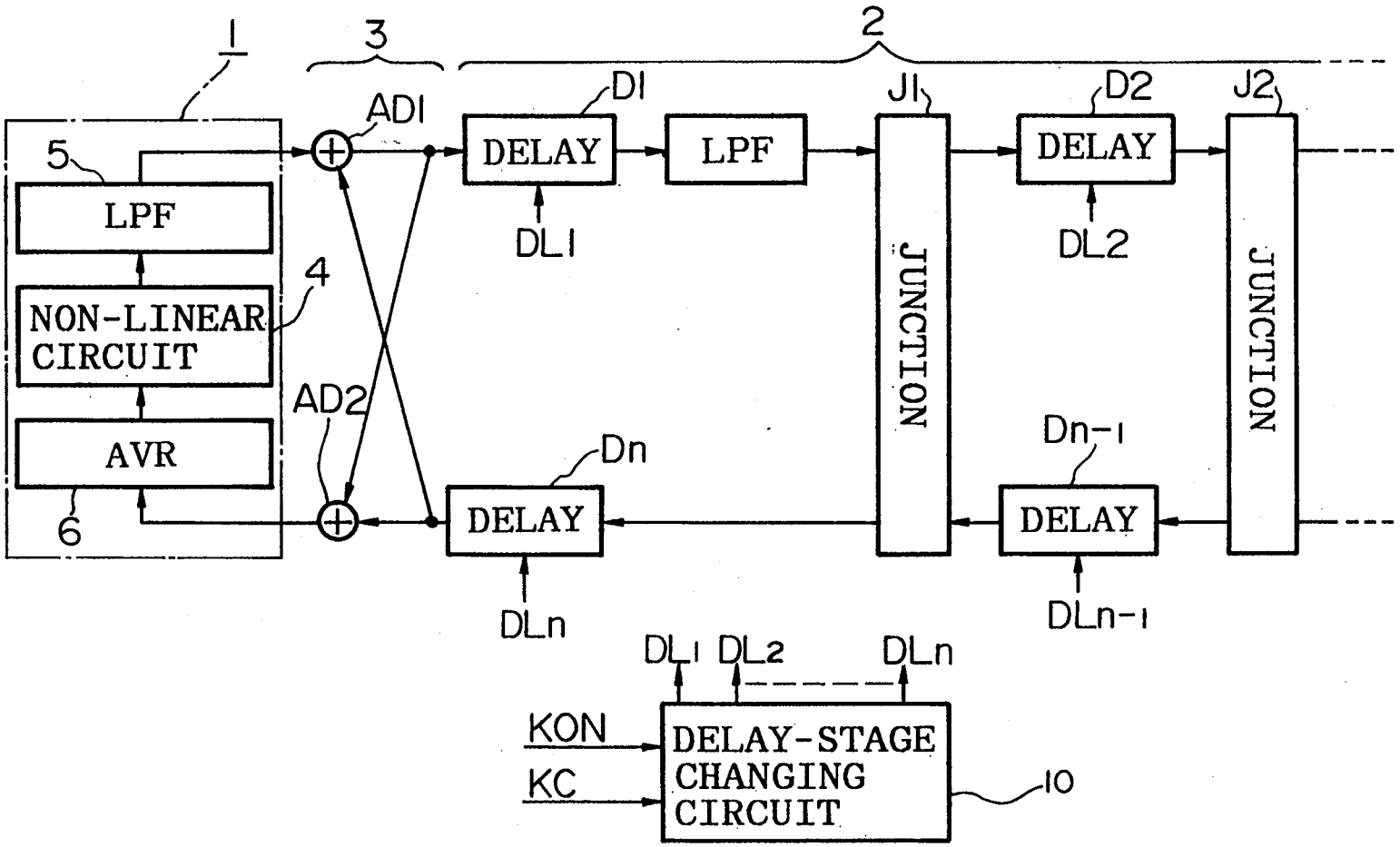
FIG. 1 (MAIN PORTION OF ELECTRONIC MUSICAL INSTRUMENT)

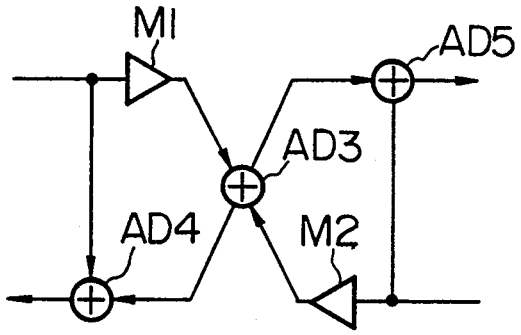
FIG.2(A)(EXAMPLE OF JUNCTION CIRCUIT)
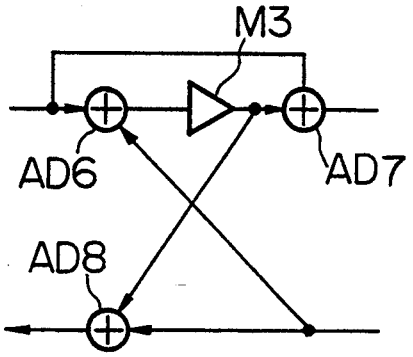
FIG.2(B)(EXAMPLE OF JUNCTION CIRCUIT)
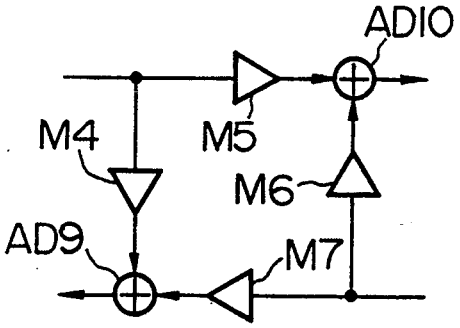
FIG.2(C)(EXAMPLE OF JUNCTION CIRCUIT)

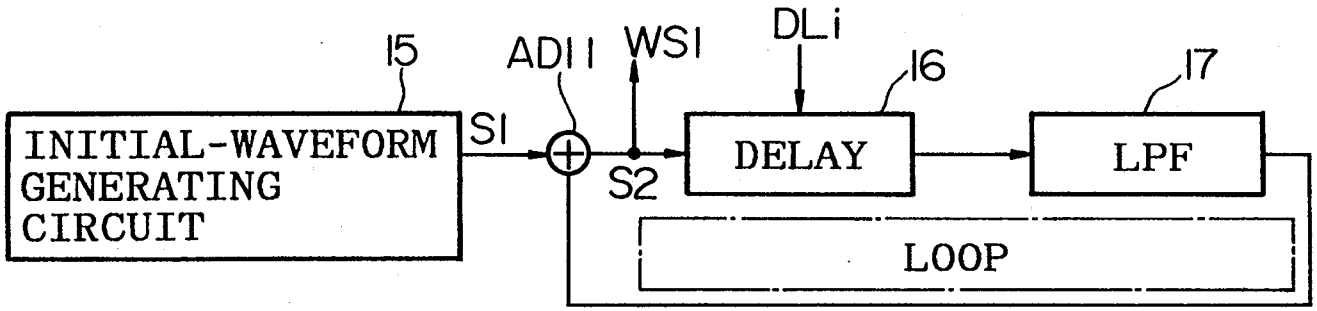
FIG.3 (PHYSICAL SOUND SOURCE SIMULATING DAMPING SYSTEM OF INSTRUMENT)

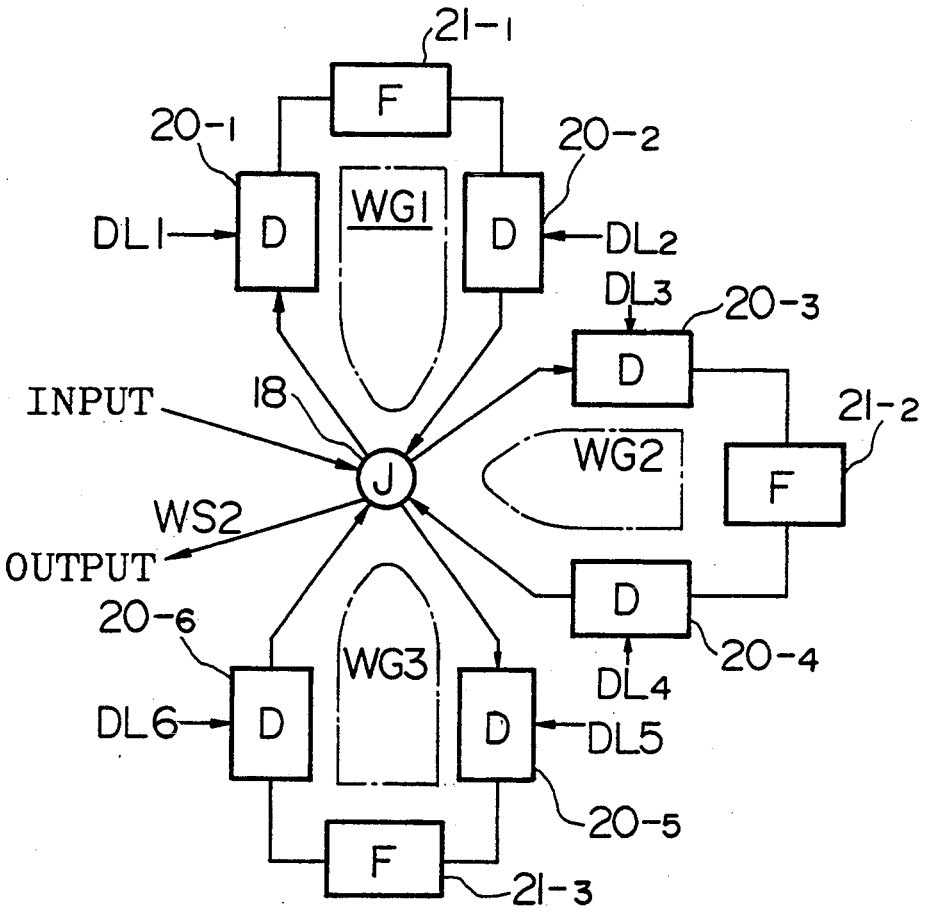
FIG.4 (WAVE-GUIDE NETWORK SIMULATING RESONANCE SYSTEM OF INSTRUMENT)

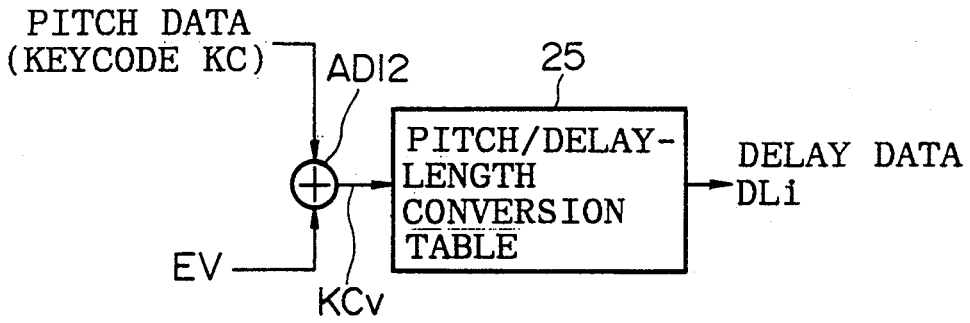
FIG.5 (DELAY-STAGE CHANGING CIRCUIT 10)
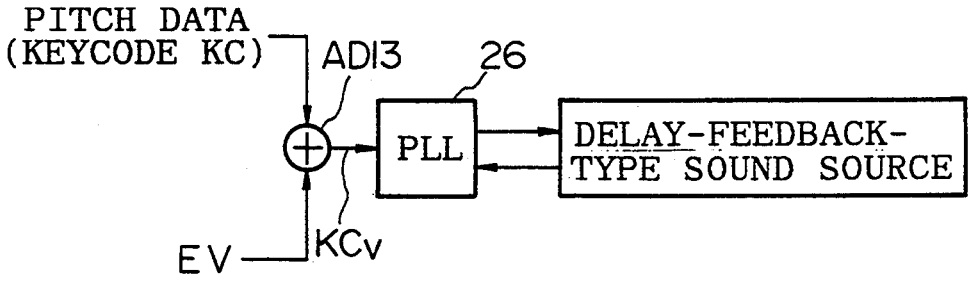
FIG.6 (DELAY-STAGE CHANGING CIRCUIT 10)

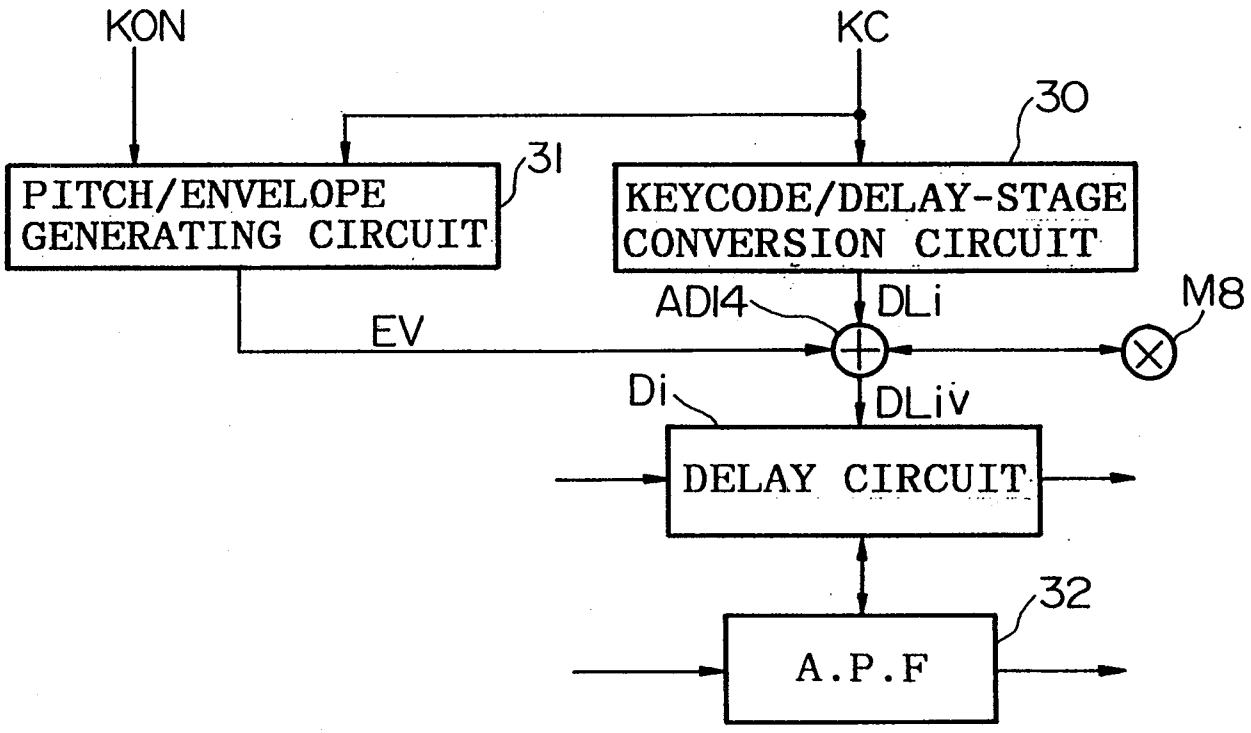
FIG. 7 (DELAY-STAGE CHANGING CIRCUIT 10)

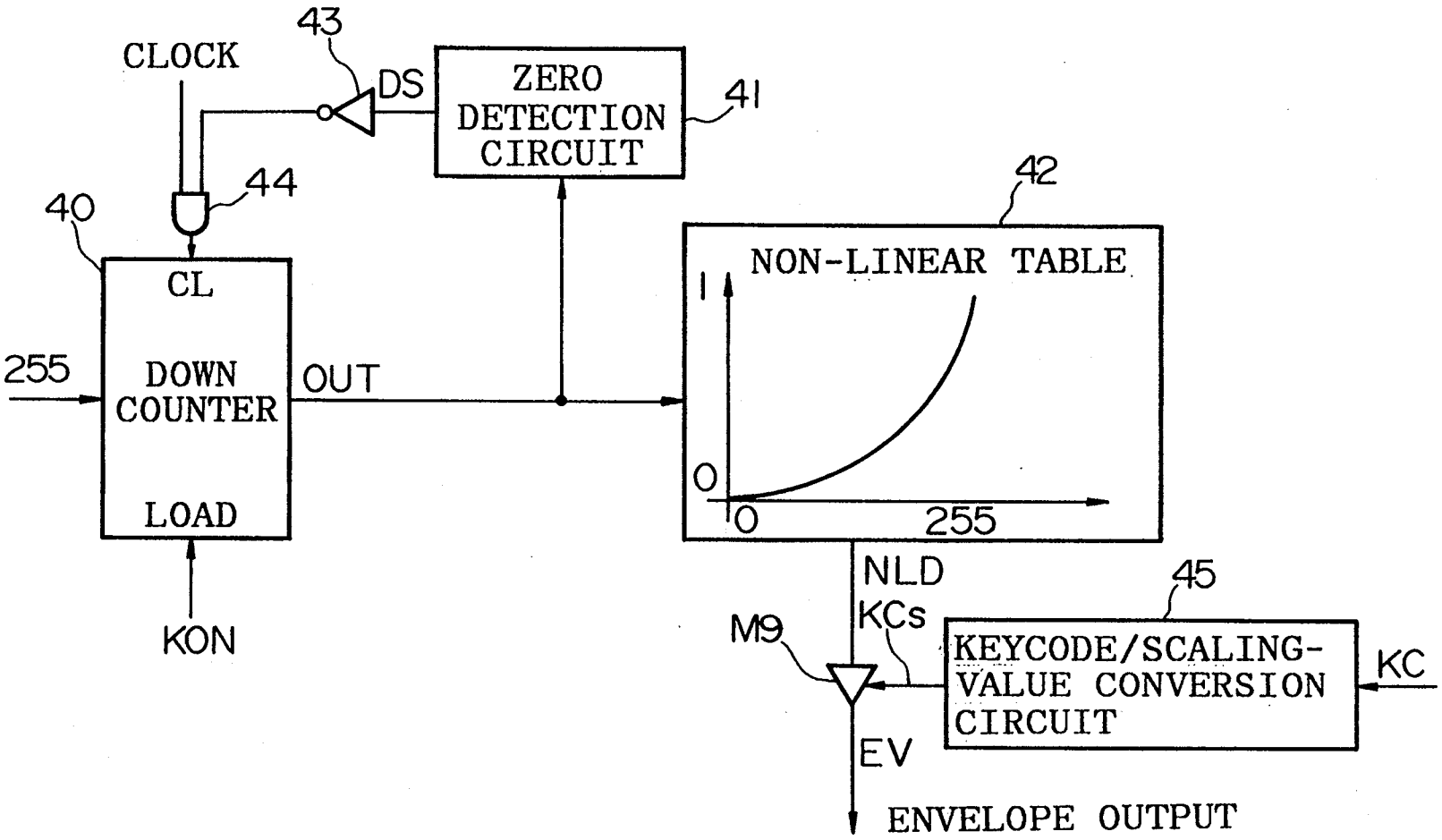
FIG.8 (PITCH/ENVELOPE GENERATING CIRCUIT 31)

ELECTRONIC MUSICAL INSTRUMENT CAPABLE OF SIMULATING SMALL PITCH VARIATION AT INITIATION OF MUSICAL TONE GENERATION

BACKGROUND OF THE INVENTION

1. Field of the Invention

The present invention relates to an electronic musical instrument which simulates a tone-generation mechanism of a non-electronic musical instrument so as to synthesize its sounds.

2. Prior Art

Conventionally, a physical sound source as disclosed in Japanese Patent Laid-Open Publication No. 63-40199 is well known as the sound source which simulates the tone-generation mechanism of the non-electronic musical instrument. This physical sound source contains the non-linear circuit and transmission circuit. The non-linear circuit is designed to simulate the generation of the vibration applied to the sounding element of the non-electronic musical instrument, while the transmission circuit is designed to simulate the propagation of the sound to be transmitted onto the string or through the tube portion.

The above-mentioned non-linear circuit outputs a predetermined excitation signal in accordance with several kinds of parameters relating to the musical tone to be generated. The excitation signal is supplied to the transmission circuit. The transmission circuit is configured as a loop circuit containing a delay circuit, a low-pass filter and the like, so that the excitation signal is circulated through the loop circuit. Such excitation signal to be circulated through the loop circuit is fed back to the non-linear circuit as its input signal. As described above, the signal circulating through the non-linear circuit and transmission circuit is picked up at an arbitrary point of the loop circuit as a musical tone signal. A musical tone is generated by a predetermined musical tone generation device in response to the musical tone signal.

The above-mentioned, so-called delay-feedback-type sound source mainly operates to perform the simulation of the non-electronic musical instrument. Herein, its delay length is determined by the musical interval or length of the string or tube of the instrument to be simulated.

However, the conventional electronic musical instrument providing the above-mentioned sound source cannot simulate all of the operations of a non-electronic musical instrument with accuracy. Therefore, some of the simulated operations may be slightly different from the actual operations of the non-electronic musical instrument. For example, in the non-electronic musical instrument, it can be observed that a small pitch variation (or pitch-rising phenomenon) is occurred at the start time of the tone-generation.

In the conventional electronic musical instrument, the pitch of the musical tone to be generated must be determined to completely match with the delay length to be set at once. Therefore, it cannot perform an active control on the musical tone in its tone-generation process. Thus, it is very difficult to simulate the above-mentioned pitch-rising phenomenon with accuracy.

SUMMARY OF THE INVENTION

It is accordingly an object of the present invention to provide an electronic musical instrument which can perform an active control on the pitch of the musical tone so that the pitch-rising phenomenon can be simulated with accuracy.

In an aspect of the present invention, there is provided an electronic musical instrument comprising: an excitation-vibration waveform generating portion which generates an excitation-vibration signal corresponding to vibration applied to a sounding element of a non-electronic musical instrument; a linear circuit portion, containing a filter and a delay circuit, which simulates propagation characteristic of the sound generated by the sounding element of the non-electronic musical instrument; an envelope generating portion which generates an envelope to be varied in a lapse of time in accordance with a pitch of a musical tone signal to be generated; and a delay amount control portion which controls delay amount of the linear circuit portion by the envelope. Herein, the excitation-vibration signal is at least circulated through the linear circuit portion, and then this signal is picked up as the musical tone signal.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings:

FIG. 1 is a block diagram showing a main portion of an electronic musical instrument according to an embodiment of the present invention;

FIGS. 2(*a*) to 2(*c*) are circuit diagrams each showing an example of the junction shown in FIG. 1;

FIG. 3 is a block diagram showing the configuration of a physical sound source simulating the damping system of the instrument;

FIG. 4 is a block diagram showing the configuration of a wave-guide network simulating the resonance system of the instrument;

FIG. 5 is a block diagram showing the configuration of a delay-stage changing circuit, shown in FIG. 1, according to a first embodiment;

FIG. 6 is a block diagram showing the configuration of the delay-stage changing circuit according to a modified example of the first embodiment;

FIG. 7 is a block diagram showing the configuration of the delay-stage changing circuit according to a second embodiment; and FIG. 8 is a block diagram showing the detailed configuration of a main portion of the delay-stage changing circuit shown in FIG. 7.

DESCRIPTION OF THE PREFERRED EMBODIMENT

[A]Overall Configuration

By referring to the drawings, description will be given with respect to an embodiment of the present invention. FIG. 1 is a block diagram showing a main portion of the electronic musical instrument according to an embodiment of the present invention. In FIG. 1, the sound source employed by the present embodiment is configured as a circuit to simulate the sounding mechanism of the wind instrument. In this sound source, an excitation-vibration circuit 1 simulating operations of a mouthpiece of the wind instrument is connected to a tube simulation circuit 2, simulating a resonance tube of the wind instrument, by means of a junction 3. Herein, the excitation-vibration circuit 1 corresponds to the foregoing non-linear circuit, while the tube simulation circuit 2 corresponds to the foregoing transmission circuit.

The junction 3 is designed to simulate the scattering manner of the air-pressure wave to be occurred at the connection portion between the mouthpiece and tube of the wind instrument. In this junction 3, an adder AD1 adds the output signals of the tube simulation circuit 2 and excitation-vibration circuit 1 together so that the addition result thereof is supplied to the tube simulation circuit 2, while another adder AD2 adds the output signals of the adder AD1 and tube simulation circuit 2 together so that the addition result thereof is supplied to the excitation-vibration circuit 1.

As described before, the excitation-vibration circuit 1 is designed to simulate the mouthpiece of the wind instrument having a single reed, and this circuit 1 consists of a non-linear circuit 4, a low-pass filter (LPF) 5 and an averaging circuit (AVR) 6. Herein, the non-linear circuit 4 provides a non-linear function such as the secondary function which is used to simulate the relationship between the slot and pressure applied to the reed in the mouthpiece, while the LPF 5 simulates the inertia, damping factors and the like of the reed.

The tube simulation circuit 2 is configured as a loop circuit in which plural delay circuits D1, D2, . . . , Dn-1, Dn are connected together in cascade manner via junctions J1, J2, . . . . Herein, the delay circuits D1-Dn simulate the propagation delay of the air-pressure wave in the tube, while the junctions J1, J2, . . . , Jn-1 simulate the scattering manner of the air-pressure wave at the tone hole and other portions at which the diameter of the tube is changed. Incidentally, number of the junctions J1, J2, . . . , Jn-1 depends on the number of the tone holes.

Next, description will be given with respect to some examples of the junction circuits by referring to FIGS. 2(*a*), 2(*b*), 2(*c*). FIG. 2(*a*) shows a general configuration of the junction circuit, wherein an input signal Is multiplied by the predetermined first constant in a multiplier M1, of which multiplication result is supplied to a first input terminal of an adder AD3. On the other hand, the circulating signal is multiplied by the predetermined second constant in a multiplier M2, of which multiplication result is supplied to a second input terminal of the adder AD3. The adder AD3 adds these multiplication results of the multipliers M1, M2 together, so that the addition result thereof is delivered to adders AD4, AD5. The adder AD4 adds the above-mentioned input signal to the output signal of the adder AD3, so that the addition result thereof is returned toward the excitation-vibration circuit 1. On the other hand, the adder AD5 adds the foregoing circulating signal to the output signal of the adder AD3, so that the addition result thereof is outputted to the next-stage circuit in the tube simulation circuit 2.

The junction circuit as shown in FIG. 2(*b*) is configured in form of the lattice-type circuit. Herein, the input signal is supplied to both of adders AD6, AD7. The adder AD6 adds the input signal and circulating signal together, so that the addition result thereof is outputted to a multiplier M3. Then, the output signal of the adder AD6 is multiplied by the predetermined third constant in the multiplier M3, of which multiplication result is outputted to the adder AD7. The adder AD7 adds the input signal to the output signal of the multiplier M3, so that the addition result thereof is outputted to the next-stage circuit in the tube simulation circuit 2. On the other hand, another adder AD8 adds the circulating signal to the output signal of the multiplier M3, so that the addition result thereof is returned toward the excitation-vibration circuit 1.

Next, the junction circuit as shown in FIG. 2(*c*) is configured in form of the four-multiplication-lattice-type circuit. Herein, the input signal is multiplied by the predetermined fourth constant in a multiplier M4, of which multiplication result is supplied to an adder AD9. Similarly, the input signal is also multiplied by the predetermined fifth constant in a multiplier M5, of which multiplication result is supplied to an adder AD10. On the other hand, the circulating signal is multiplied by the predetermined sixth and seventh constants in multipliers M6, M7 respectively, and then, the multiplication results of these multipliers M6, M7 are respectively supplied to the adders AD10, AD9. The adder AD9 adds the output signals of the multipliers M4, M7 together, so that the addition result thereof is returned toward the excitation-vibration circuit 1. On the other hand, the adder AD10 adds the output signals of the multipliers M5, M6 together, so that the addition result thereof is outputted to the next-stage circuit in the tube simulation circuit 2.

Each of the above-mentioned junction circuits is designed to simulate the scattering manner of the air-pressure wave at the portion at which the diameter of the tube is changed.

Each of the delay circuits D1-Dn in the tube simulation circuit 2 is configured with shift registers, each of which further in turn is configured with flip-flops corresponding to the number of bits of the digital signal to be transmitted therethrough. In short, the total delay amount of the delay circuit depends on the number of the shift registers. In the present embodiment, the number of the delay circuits D1-Dn is controlled by delay-stage signals DL1, DL2, . . . , DLn-1, DLn output from a delay-stage changing circuit 10.

Upon receipt of a key-on signal KON, the delay-stage changing circuit 10 outputs the delay-stage signals DL1-DLn, corresponding to the delay circuit D1-Dn, in accordance with a keycode KC. Herein, these delay-stage signals DL1-DLn are controlled by the predetermined envelope. Under control of these signals DL1-DLn, the musical tone signals are sequentially synthesized, and the number of delay circuits to be used is changed in accordance with the envelope during generation of the musical tones.

[B]Applicable Examples (1) Application to Vibration-Damping System of Instrument FIG. 3 is a block diagram showing the configuration of the physical sound source, according to the present invention, which is applied to the vibration-damping system of the instrument. Such damping-type physical sound source is configured by the circuit simulating the sounding mechanism of the stringed instrument. Herein, an initial-waveform generating circuit 15 generates a signal S1 corresponding to the force applied to the sounding element of the stringed instrument, i.e., string. This signal S1 is supplied to an adder AD11. Next, a closed-loop circuit "LOOP" is configured by the circuit simulating the propagation of the vibration to be transmitted onto the string. More specifically, this circuit LOOP contains a delay circuit 16, simulating the propagation delay of the vibration, and a low-pass filter 17, simulating the frequency characteristic of the vibration on the string. According to this frequency characteristic, vibration is damped faster as the frequency becomes higher.

In the closed-loop circuit LOOP, a signal S2 is circulated, and this signal S2 is supplied to the adder AD11. Thus, this circulating signal S2 is fed back to the aforementioned signal S1 corresponding to the force applied to the string. While circulating through the closed-loop circuit LOOP, the circulating signal S2 is picked up at an arbitrary point of LOOP as a musical tone signal WS1.

As similar to the foregoing physical sound source of the wind instrument, in this damping-type physical sound source, number of the delay stages of the delay circuit 16 is controlled by the time-variable delay-stage signal DLi (where i=1 to n) outputted from the delay-stage changing circuit 10, wherein level of this time-variable delay-stage signal is varied in a lapse of time.

(2) Application to Wave-Guide Network of Resonance System of Instrument

FIG. 4 is a block diagram showing the configuration of the wave-guide network simulating the resonance system of the instrument. In order to simulate the resonance system in which the musical sound is propagated in all directions, this wave-guide network provides plural closed-loop circuits. In the example shown in FIG. 4, there are provided three closed-loop circuits, i.e., wave-guides WG1, WG2, WG3 which are connected together by a junction 18. The input signal applied to the junction 18 is mixed together with all of the signals circulating through the wave-guides WG1-WG3 so that the mixed signal is returned back to the wave-guides WG1-WG3.

As similar to the foregoing closed-loop circuit LOOP, each of the wave-guides WG1-WG3 consists of two delay circuits (i.e., 20-1, 20-2, . . . , 20-6) and one filter (i.e., 21-1, 21-2, 21-3). The mixed signal in the junction 18 is outputted as a musical tone signal WS2.

Even in the above-mentioned wave-guide network simulating the resonance system of the wind instrument, as similar to the foregoing physical sound source simulating the damping system of the wind instrument, number of delay stages in the delay circuit 20-1, . . . , 20-6 is controlled by the time-variable delay-stage signal DL1, . . . , DL6.

[C]Embodiments of Delay-Stage Changing Circuit 10

Next, detailed description will be given with respect to some embodiments of the delay-stage changing circuit 10 by referring to FIGS. 5 to 8.

(1) First Embodiment

FIG. 5 is a block diagram showing the configuration of the delay-stage changing circuit 10 according to a first embodiment of the present invention.

In FIG. 5, this circuit consists of an adder AD12 and a pitch/delay-length conversion table 25. Herein, the adder AD12 applies the envelope to the pitch data such as the keycode KC, while the pitch/delay-length conversion table 25 converts the output of the adder AD12 into the delay length. More specifically, the keycode KC is supplied to a first input terminal of the adder AD12, while an envelope EV, generated by the predetermined envelope generating circuit (of which configuration and operation will be described later), is supplied to a second input terminal of the adder AD12. By adding the envelope EV to the keycode KC, the adder AD12 generates a time-variable keycode KCv.

This time-variable keycode KCv is supplied to the pitch/delay-length conversion table 25 which memorizes the number of delay stages in the delay circuit in connection with each pitch (i.e., keycode KC) of the musical tone to be generated in advance. Thus, this table 25 outputs the delay-stage signal DLi which corresponds to the keycode KC to be varied. This delay-stage signal DLi is supplied to the foregoing delay circuit D1-Dn of the tube simulation circuit 2 shown in FIG. 1, for example.

(2) Modified Example of First Embodiment

FIG. 6 is a block diagram showing the configuration of the delay-stage changing circuit 10 according to a modified example of the first embodiment. This example is characterized by providing a phase locked loop (i.e., PLL) 26. It is known that the pitch of the musical tone signal synthesized in the so-called delay-feedback-type sound source, as shown in FIGS. 1-4, can be controlled by the PLL circuit. In FIG. 6, the PLL circuit 26 is controlled by the time-variable keycode KCv outputted from an adder AD13 (corresponding to AD12 in FIG. 5), so that the locked frequency of the PLL circuit 26 (i.e., pitch of the musical tone signal) is changed by KCv.

(3) Second Embodiment

FIG. 7 is a block diagram showing the configuration of the delay-stage changing circuit 10 according to a second embodiment. In FIG. 7, a keycode/delay-stage conversion circuit 30 outputs the delay-stage signal DLi on the basis of the keycode KC in order that the musical tone having a pitch represented by the keycode KC is to be generated. This signal DLi is supplied to an adder AD14. On the other hand, when receiving the key-on signal kON, a pitch/envelope generating circuit 31 generates an envelope EV on the basis of the keycode KC. This envelope is supplied to the adder AD14. The adder AD14 adds the envelope EV to the delay-stage signal DLi so as to output the addition result thereof as a time-variable delay-stage signal DLiv to the delay circuit Di.

The delay circuit Di has the similar configuration of the delay circuits as shown in FIGS. 1, 3, 4. Herein, the number of delay stages applied with the envelope, i.e., time-variable delay-stage signal DLiv, is set to this delay circuit Di. Incidentally, this delay circuit D1 can be replaced by an all-pass filter 32 which is inserted in the tube simulation circuit 2. In this case, instead of setting the time-variable delay-stage signal DLiv, parameters which vary the frequency characteristic are set to the filter.

For example, in case of the delay circuit providing one-hundred delay stages, fifty delay stages of them are selected to generate a musical tone of which pitch is one octave higher. At this time, when a decimal number "3" representing the envelope data EV is added to the delay-stage signal DLi representing fifty delay stages, the pitch of the musical tone to be generated must be varied more as comparing to the case where "3" is added to one-hundred delay stages. In order to avoid such an event, when adding the envelope data to the number of delay stages in the adder AD14, the delay-stage signal DLi is determined by referring to the keycode KC. Therefore, in the above-mentioned example where fifty delay stages within one-hundred delay stages are selected, value of the envelope data EV is reduced to the half in order to maintain the proportional relationship between the value of envelope data and number of delay stages.

In FIG. 7, the adder AD14 can be replaced by a multiplier M8. In order to obtain the same operation result of the adder AD14, the envelope data EV must be changed. When simulating the example where the envelope value "3" is added to the number of delay stages "100" by the adder AD14, this number "100" must be multiplied by the coefficient "1.03" by the multiplier M8. Even in the case where number of delay stages "50" is selected, this number "50" is multiplied by the same coefficient "1.03" by the multiplier M8, of which multiplication result comes equal to "51.5". Thus, it is not necessary to change the multiplication coefficient by referring to the keycode KC.

(4) Detailed Configuration of Pitch/Envelope Generating Circuit

FIG. 8 is a block diagram showing the detailed configuration of the pitch/envelope generating circuit 31 which is used in the circuitry shown in FIG. 7, employing the adder AD14. Herein, when receiving the key-on signal KON, a down counter 40 counts down the predetermined value (e.g., "255") in synchronism with "CLOCK", so as to supply the output thereof to a zero detection circuit 41 and a non-linear table 42 respectively.

The zero detection circuit 41 detects whether or not the output "OUT" of the down counter 40 reaches at "0". This circuit 41 outputs a signal DS of which value is normally set at "0". When detecting "OUT" at "0", the output DS of the zero detection circuit 41 is raised up to "1". This output DS is supplied to a first input terminal of an AND gate 44 via a NOT circuit 43. Herein, clock "CLOCK" having the predetermined period is supplied to a second input terminal of the AND gate 44. When the first input of this AND gate 44 is at "1", "CLOCK" is supplied to a clock input terminal CL of the down counter 40. On the other hand, when the first input of the AND gate 44 is set at "0", the AND gate 44 shuts out the supply of "CLOCK".

Next, the non-linear table 42 stores non-linear data NLD in advance. The value of this data NLD is continuously varied from "0" to "1" in response to the output data of the down counter 40 of which value varies from "0" to "255". Thus, this non-linear table 42 outputs the non-linear data NLD to a multiplier M9 in response to the output data of the down counter 40.

In order to synthesize the musical tone having the predetermined pitch, a keycode/scaling-value conversion circuit 45 performs a scaling operation on the keycode KC to output a scaled keycode KCs to the multiplier M9.

This keycode/scaling-value conversion circuit 45 outputs the scaled keycode KCs in proportional to the number of delay stages. For example, "3" is outputted from this circuit 45 in case of ten delay stages, while "1.5" is outputted in case of five delay stages. In the case where the multiplier M8 is employed in the circuitry shown in FIG. 7 instead of the adder AD14, this circuit 45 is configured as a simple table which outputs the predetermined constant.

The multiplier M9 multiplies the non-linear data NLD by the scaled keycode KCs so as to output the multiplication result thereof to the adder AD14 or multiplier M8 shown in FIG. 7 as the envelope EV.

Next, description will be given with respect to the operation of the delay-stage changing circuit 10 according to the second embodiment as shown in FIGS. 7, 8.

Until the receipt of the key-on signal KON, the output "OUT" of the down counter 40 shown in FIG. 8 is remained at "0". Thus, the zero detection circuit 41 outputs "DS" at "1". Therefore, the AND gate 43 is set in the closed state, and consequently, the clock "CLOCK" is not supplied to the down counter 40.

When receiving the key-on signal (i.e., key-on pulse) KON, an initial value "255" is loaded to the down counter 40. In other words, the output value of the down counter 40 is set at "255". Since zero is not detected, the zero detection circuit 41 outputs "0" as DS. As a result, the AND gate 44 is set in the open state, so that the clock is supplied to the clock input terminal CL of the down counter 40. Thus, the down counter 40 starts to perform the count-down operation in synchronism with "CLOCK".

In response to the count value "OUT" which is sequentially reduced from "255", the non-linear data NLD outputted from the non-linear table 42 is continuously reduced from "1".

In response to the keycode KC, the keycode/scaling-value conversion circuit 45 outputs the scaled keycode KCs to the multiplier M9. This multiplier M9 multiplies the non-linear data NLD by the scaled keycode KCs, so that the multiplication result thereof represents the envelope EV of which value is reduced in a lapse of time. Such envelope EV is supplied to one input terminal of the adder AD14 shown in FIG. 7.

On the other hand, the keycode/delay-stage conversion circuit 30 shown in FIG. 7 outputs the delay-stage signal DLi representing the number of delay stages on the basis of the keycode KC, and this delay-stage signal DLi is supplied to another input terminal of the adder AD14. Thus, the adder AD14 adds the number of delay stages DLi and envelope EV together so as to output the time-variable delay-stage signal DLiv representing the number of delay stages applied with the envelope. This signal DLiv is supplied to the delay circuits D1 to Dn in the tube simulation circuit 2 shown in FIG. 1. As described before, this signal DLiv is varied in accordance with the envelope EV in a lapse of time.

Since the value of the envelope EV is gradually reduced, the number of delay stages DLi will be reduced to the smaller number. As a result, pitch of the musical tone to be generated is remained relatively low in the initial timing, while it is gradually raised higher. In short, the present embodiment can simulate the pitch-rising phenomenon to be occurred in the performance of the non-electronic musical instrument with accuracy.

When the output of the down counter 40 reaches at "0", the output DS of the zero detection circuit 41 is turned to "1", which sets the AND gate 44 in the closed state where the clock "CLOCK" is not supplied to the down counter 40.

In the ease where the delay circuit is divided into plural circuits as shown in FIG. 1, It: is possible to change the number of delay stages DLi (where i=1 to n) of one specific delay circuit by the envelope EV.

In the present embodiment, the envelope EV is generated in accordance with the key-on event KON. However, it is possible to modify the embodiment such that the envelope is controlled by the other performance information such as a key-off event KOFF.

Instead of scaling the varied value of the envelope EV by the keycode KC, it is possible to perform the scaling operation on the envelope EV by the touch information. When configuring the circuitry shown in FIG. 7 by use of the multiplier M8 instead of the adder AD14, it is possible to omit the scaling operation using the keycode KC.

Instead of using the delay circuit Di in FIG. 7, it is possible to use the all-pass filter 32 by which the delay amount is controlled. In this case, instead of the number of delay stages, the filter coefficient is supplied to the all-pass filter 32.

Further, it is possible to simultaneously use both of the delay circuit Di and all-pass filter 32 by which the delay amount is controlled.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:

excitation-vibration waveform generating means for generating an excitation-vibration signal corresponding to a vibration of a sound to be simulated;

linear circuit means including a delay for circulating and delaying the excitation-vibration signal so as to simulate a propagation characteristic of a sound;

operator means for generating a tone generation designation signal and for designating a nominal pitch of a tone to be generated;

pitch variation data generating means for generating, responsive to the tone generation designation signal, pitch variation data having a value which varies with time from an initial value to a predetermined value; and delay control means for controlling a delay amount of said linear circuit means in accordance with said designated pitch and said pitch variation data to vary the delay amount with time from an initial amount to a predetermined amount, whereby said excitation-vibration signal circulating through at least said linear circuit means is picked up as a musical tone signal.

2. An electronic musical instrument as defined in claim 1 wherein said linear circuit means contains a filter and a delay circuit for respectively filtering and delaying a signal input thereto.

3. An electronic musical instrument as defined in claim 1 wherein said sound to be simulated is a wind instrument sound.

4. An electronic musical instrument as defined in claim 1 wherein said linear circuit means includes a selectable number of delay stages, said delay amount corresponding to the selected number of delay stages to be used, said delay control means selecting the number of delay stages to be used in accordance with the pitch of the musical tone signal.

5. An electronic musical instrument according to claim 1, further including scaling means for selectively scaling the tone generation designation signal, wherein the pitch variation data generating means generates the pitch variation data in accordance with the scaled tone generation designation signal.

6. An electronic musical instrument according to claim 1 wherein said pitch variation data is generated in accordance with said designated pitch.

7. An electronic musical instrument in accordance with claim 1 wherein the pitch variation data is provided in units of delay length and wherein said delay control means further includes a pitch/delay length conversion means for converting said designated pitch into a delay length corresponding to said designated pitch, said delay amount of said linear circuit means being determined in accordance with said delay length and said pitch variation data.

8. An electronic musical instrument according to claim 1, wherein the predetermined value corresponds to zero, and the predetermined amount corresponds to a delay amount associated with the nominal pitch.

9. An electronic musical instrument according to claim 1, further including scaling means for scaling said pitch variation data in accordance with an operation of said operator means.

10. An electronic musical instrument comprising:

detecting means for detecting at least performance information representing generation and/or suspension of a musical tone and for designating a nominal pitch of the musical tone;

generating means for generating an excitation signal;

linear circuit means including delay means having a predetermined total delay amount for circulating and delaying said excitation signal;

pitch variation data generating means for generating pitch variation data having a value which varies with time from an initial value to a predetermined value; and delay control means for controlling the delay amount of said linear circuit means in accordance with said designated pitch and said pitch variation data.

11. An electronic musical instrument as defined in claim 10 wherein said delay control means further includes a pitch/delay-length conversion table for converting a sum of the nominal pitch of the musical tone and the value of the pitch variation data into the delay amount to be used in the linear circuit means.

12. An electronic musical instrument according to claim 5, further including scaling means for selectively scaling the performance information, wherein the pitch variation data generating means generates the pitch variation data in accordance with the scaled performance information.

13. An electronic musical instrument according to claim 10, wherein the delay control means controls the delay amount such that said delay amount corresponds to an amount associated with the nominal pitch when the pitch variation data equals the predetermined value.

14. An electronic musical instrument according to claim 10, further including scaling means for scaling said pitch variation data in accordance with said detected performance information.

* * * * *